United States Patent [19]

Hirsch

[11] 4,365,813

[45] Dec. 28, 1982

[54] WORD GAME

[76] Inventor: Ernest Hirsch, 155 Sharene La., #309, Walnut Creek, Calif. 94569

[21] Appl. No.: 939,838

[22] Filed: Sep. 5, 1978

[51] Int. Cl.[3] ..... A63F 3/00

[52] U.S. Cl. ..... 273/272

[58] Field of Search ..... 273/272, 299

[56] References Cited

U.S. PATENT DOCUMENTS

| | | | |
|---|---|---|---|
| 1,319,561 | 10/1919 | Brenner | 273/272 |
| 1,539,015 | 5/1925 | Mitchell | 273/146 |
| 1,553,835 | 9/1925 | Peters . | |
| 1,591,639 | 7/1926 | McDonald . | |
| 2,602,667 | 7/1952 | Poarch . | |
| 3,655,195 | 4/1972 | Bean . | |
| 3,984,106 | 10/1976 | White . | |
| 4,014,548 | 3/1977 | Trilling | 273/272 |
| 4,155,556 | 5/1979 | Flacione | 273/272 X |

FOREIGN PATENT DOCUMENTS 573343 2/1958 Italy .

OTHER PUBLICATIONS

"Ghost", p. 272 of Reader's Digest Book of 1000 Family Games, Jun. 1973.

"Ghosts", p. 254 of the Way to Play by Diagram Group, Mar. 1976.

*Primary Examiner*—Harland S. Skogquist

[57] ABSTRACT

A word game including a plurality of playing pieces each having either a letter of the alphabet and a value indicator thereon or being universally useful as any letter of the alphabet, a ratio of lettered to universally useful pieces being at least about 10 to 1. A playing surface having a plurality of contiguous playing piece accepting playing spaces thereon in linear array. A device for generating a number by chance from a selected set of numbers to multiply the sum of the value indicators of the playing pieces on the playing surface to obtain a product after a player takes his turn. A plurality of value markers or the like to be paid to the player in an amount determined by the product developed on his turn. Also, a method of playing the word game utilizing the aforementioned structures.

26 Claims, 5 Drawing Figures

WORD GAME

BACKGROUND OF THE INVENTION

Field of the Invention

Quite a number of games are known wherein words are formed on a playing surface by placing tiles having letters thereon and numbers which indicate the value of each letter on the playing surface. One such game is taught for example in U.S. Pat. No. 1,591,639 issued to E. R. McDonald. Another is taught in U.S. Pat. No. 3,655,195 issued to Bean, et al. Still other games which utilize letters are taught in Italian Pat. No. 573,343, U.S. Pat. No. 1,553,835, U.S. Pat. No. 2,602,667 and U.S. Pat. No. 3,984,106.

In the great majority of prior art word forming games, the element of chance is emphasized only through the random selection of the letter tiles. Thus, the winners of these games are generally primarily determined by the relative skills of the players participating in them. Certainly, such games are not designed for adjustability of the relative importance played by chance and skill. Further, the prior art games do not generally provide a mode for "bluffing" one's opponents to try to defeat them at the game.

It would be desirable to provide a word forming game wherein the element of chance was balanced more closely with the element of skill so that even a poor player having a relatively good run of luck could more easily defeat a better player. It would also be advantageous if the relative importance of chance and skill could be varied within limits. It would further be desirable if such a word forming game could be made more interesting by including bluffing as an integral part of the game. It would also be desirable if such a game was provided wherein the different players in the game could be building towards different words at the same time thus causing shifts in emphasis as words are being formed.

SUMMARY OF THE INVENTION

The present invention is directed to providing a game and a method of playing that game which have all the just mentioned desirable attributes.

In one sense the invention relates to a word building game apparatus which comprises a plurality of playing pieces each having either a letter of the alphabet and a value indicator thereon or being universally useful as any letter of the alphabet, a ratio of lettered to universally useful pieces being at least about 10 to 1. The apparatus further comprises a playing surface having a plurality of contiguous playing piece accepting playing spaces thereon in linear or crossed linear array. Means are provided for generating a number by chance from a selected set of numbers, to multiply the sum of the value indicators of the playing pieces on the playing surface after a player takes his turn, to obtain a product. Means are provided for increasing the amount of a players score in an amount determined by the product developed at his turn.

In another sense, the invention relates to a method of playing a word building game. The method comprises providing a plurality of playing pieces each having either a letter of the alphabet and a value indicator thereon or being universally useful as any letter, a ratio of lettered to universally useful pieces being at least about 10 to 1. Each of a plurality of players are supplied with value markers. Each of the players selects up to a fixed minimum number of playing pieces, the maximum number not being sufficient to form an entire allowable word, at random and without knowledge of the letter or value thereof or whether the selected pieces are universally useful, from the plurality of playing pieces. Each of the players at his turn is given an option of contributing to a word by placing at least one of the playing pieces on one of a plurality of playing piece accepting spaces which are in linear or crossed linear array on a playing surface. Each of the players at his turn is given an opportunity to discard one or more of his pieces in return for a reduction in his supply of value markers. Each of the players at his turn can, if he elects to contribute to a word, generate a number of chance from a selected set of numbers. When any of the players has contributed to a word, said number is multiplied by the sum of the value indicators on all of the pieces forming a part of the word to generate a product. A player's score is increased in an amount determined by the product. The players repeat their turn until play is terminated when a completed word is formed or when all players in rotation have elected to not attempt to place a playing piece on one of the playing spaces, whichever occurs first.

BRIEF DESCRIPTION OF THE DRAWING

The invention will be better understood by reference to the figures of the drawing wherein like numbers denote like parts throughout and wherein.

DETAILED DESCRIPTION OF THE PREFERRED EMBODIMENTS

Figure 1:
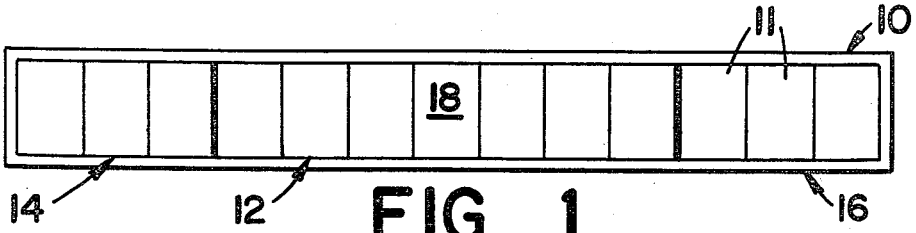
FIG. 1 illustrates a game board or word rack in accordance with one embodiment of the present invention.

The FIG. 1 Embodiment

Figure 5:
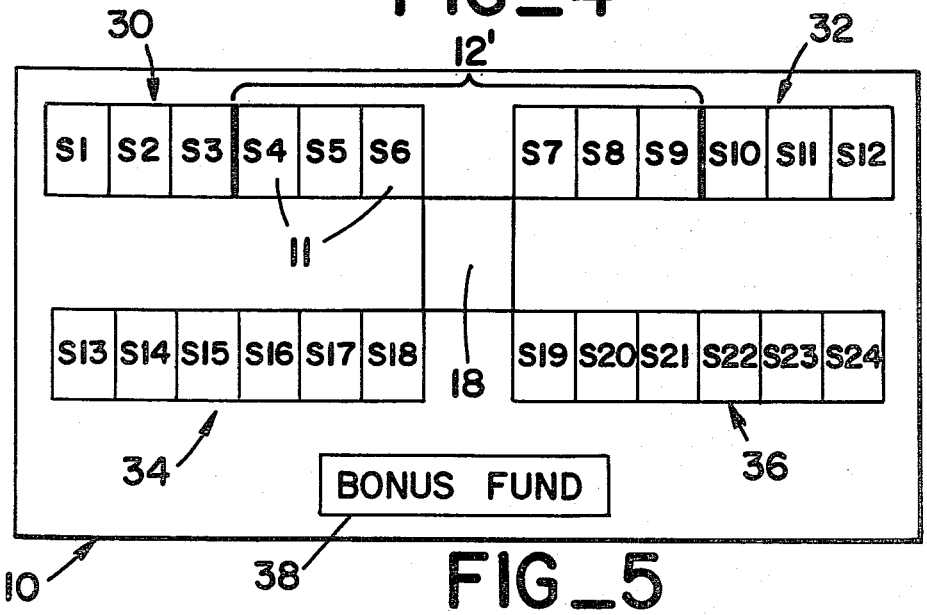
FIG. 5 illustrates an alternate embodiment of a word rack useful in the present invention.

Adverting to FIG. 1 of the drawing, there is illustrated a game board or word rack 10 having playing spaces 11 arranged in linear array and having a central starting area 12, a leftward area 14 and a rightward area 16. It will be noted that the leftward area 14 would be that portion of the game board 10 which receives letters which occur in words before those letters in the central starting area 12 and that the rightward playing area 16 receives letters which occur after the letters in the central starting area. The words leftward and rightward are used for convenience and it should be understood that in languages which read from right to left the reverse order is intended. It should also be understood that the term linear array is used to indicate a contiguous sequence and is not limited to the playing spaces 11 being in a straight line, thus, for example, it will include a crossed linear array as illustrated in FIG. 5.

Figure 2:
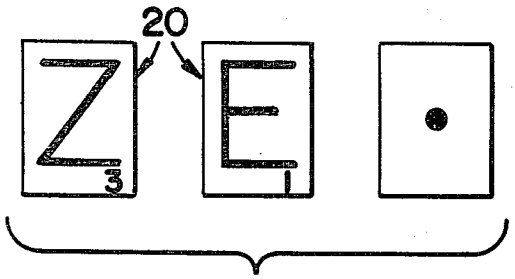
FIG. 2 illustrates playing pieces or tiles useful in accordance with the present invention.
Figure 3:
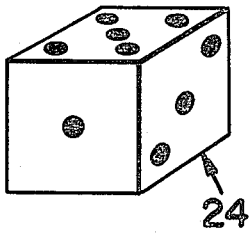
FIG. 3 illustrates a die useful for generating a number by chance for use in accordance with the present invention.
Figure 4:
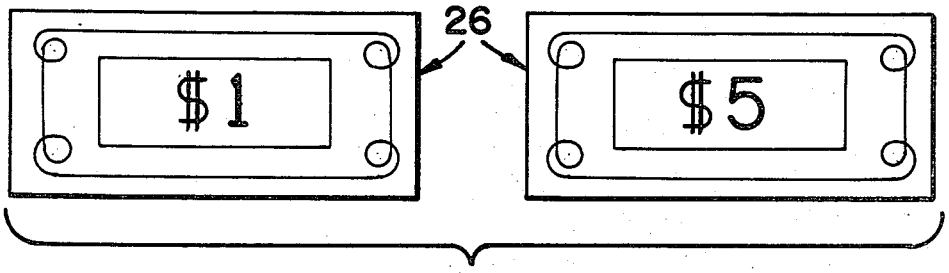
FIG. 4 illustrates value markers useful in keeping track of a player's score in accordance with the present invention.

A start space 18 is provided generally centrally in the starting area 12. Tiles 20, shown in FIG. 2, one or more of which may be "wild" (DOT) tile are each placeable in one of the playing spaces 11 on the playing surface of the game board 10. A die 24 serves as a number generator for providing multipliers for reasons which will shortly become apparent. A plurality of value markers 26 are shown in FIG. 4 in the form of play money.

It should be noted that there are a number of variations possible in the game apparatus. For example, the game board 10 can be extended vertically as well as horizontally into a generally X shape wherein two (or four) words can be formed at the same time through the same start square 18. Further, the various parts of the apparatus can be made of a number of different materials. Still further, the value markers 26 can be replaced by simply a score pad or the like on which the score of each player is kept, chips, real money, or any other value marking devices. Still further, the die 24 can be replaced by any other type of number generator, for example, a spinner which is struck by a finger and has a pointer which points at one of a plurality of numbers set out in a board or other structure to which the spinner is mounted, with the numbers on the board or other structure serving as the numbers being generated. Or, if desired, two or more dies such as the die 24 may be utilized.

Method of Play With FIG. 1 Embodiment

An overall apparatus might consist of one game board 10 along with an assortment of forty of the playing pieces or tiles 20, one die 24 and some denomination in play money, for example $2,050.00. The play money can be broken down into twenty-five $50.00 bills, fifty $10.00 bills, fifty $5.00 bills and fifty $1.00 bills. The total quantity of each letter can be arranged to correlate somewhat with its natural occurrence in words. Face values can be assigned to the letters which are more or less inversely proportional to the normal occurrences of these letters in words. Thus, the following table might set out the letters, the quantities of the letters and their face values:

| Number of Tiles | Letter | Face Value | Number of Tiles | Letter | Face Value |
|---|---|---|---|---|---|
| 2 | A | 1 | 2 | N | 1 |
| 1 | B | 2 | 2 | O | 1 |
| 1 | C | 2 | 1 | P | 2 |
| 2 | D | 1 | 1 | Q | 3 |
| 3 | E | 1 | 2 | R | 1 |
| 1 | F | 2 | 2 | S | 1 |
| 2 | G | 1 | 2 | T | 1 |
| 1 | H | 2 | 2 | U | 1 |
| 2 | I | 1 | 1 | V | 2 |
| 1 | J | 3 | 1 | W | 2 |
| 1 | K | 2 | 1 | X | 3 |
| 2 | L | 1 | 1 | Y | 2 |
| 1 | M | 2 | 1 | Z | 3 |
| | | | 1 | DOT | 0 |

Each game consists of a plurality of word rounds. Each word round is completed by completion of an allowable word or the inability to complete an allowable word as explained in more detail in following. The number of word rounds to be played should be chosen to be evenly divisible by the number of players. The order in which each player is to play is normally randomly selected, for example, by having each player draw a tile with the player whose tile has the lowest (or highest) letter in the alphabet starting the first word round and then having each player to his left follow him in turn.

Each of the letters are placed in a reserve pile with their face down so that only a blank surface is visible and so that the players do not know what letter or what value each tile has.

Each player is given a preliminary amount of money, for example one hundred ($100.00) dollars. The player chosen as the first player then selects one or more letter tiles from the reserve pile. A charge may be made for the tile or tiles selected and the total number which may be selected is limited, for example, to three. The money is paid into a bonus fund.

The first player is then given the option of contributing to a word, or more specifically of starting a word. To start a word the first player must play at least one tile on the start space 18. He may play up to a total of three tiles (two more tiles) at his turn and each of these must be played in starting area 12.

Before receiving his award or score for placing letters on the game board, the player must ask the other players in rotation if they wish to challenge the word he is supposedly building towards. If he is challenged he must point out a "legal" word (generally of at least seven letters in length) which can be produced completely on the board with the existing residual letters, to the challenger only, and, if he cannot point out such a word, he must remove all of the pieces he contributed to the word at his last turn and pay a penalty in value markers (or shift part of his score) to the challenging player. The DOT tile cannot be used to increase the total number of letters of any particular kind in the reserve pile. That is, if there are no "e"'s in the reserve pile or in the player's hand, the DOT tile may not be used as an "e". If the challenged player can identify an allowable word, the challenger must pay him a penalty in value markers (or must transfer part of his score). The unsuccessful party in a challenge situation forfeits his next playing turn in the word round but must pay each player who scores just as is he was fully participating.

The players can define between themselves what constitute allowable or legal words or can simply adopt the rule that any seven letter or longer word found non-capitalized in an unabridged dictionary is allowable. It is clear that a player can purposefully bluff by playing pieces which do not build toward an allowable word and then himself challenge the next player who adds a letter or letters.

A player may skip his turn (pass) if he desires in which case he pays a penalty, e.g., $5.00, to the bonus fund. The round then proceeds to the next player on the left.

A player may purchase one, two or three tiles from the reserve pile, at his turn, but may never have more than a total of three tiles in his possession at any time. The purchase of one tile could cost $1.00, of two tiles $3.00 and three tiles $5.00, all of which is paid to the bonus fund. If a player elects to place letters on the game board 10, his turn is thereafter treated just as the first player's turn has been treated.

Play continues until a complete allowable word has been formed or until each of the players in turn have elected to not purchase tiles or contribute to a word, i.e., to pass. If a word is completed, the player completing the word receives, in addition to the normal score for playing tiles, a bonus of the accumulated money in the bonus fund plus an amount payable by each of the other players of the sum of the face values of the tiles left in the possessions of each of the other players.

An overall game will generally consist of an agreed upon number of word rounds which number is an integral multiple of the number of players, thus giving each of the players the chance to start an equal number of words.

One or more universally useful pieces or tiles will normally be provided as a "wild" tile (denoted in the table as a DOT) useful as any letter. Such a DOT tile will normally not have a numerical value, although, if desired, such a numerical value can be assigned. Any time a player has the appropriate letter for replacing the DOT tile, and it is his turn to play, he may replace it with the appropriate letter and he obtains the DOT tile for his own use. He is credited with the placed tile as though it had been an original placement. Each new round is started with all letters in the reserve pile. Money is not redistributed before each round and, hence, the effect of money or other value marker transfer is cumulative.

It will be noted that the game has been described in rather great detail, even insofar as describing the particular number of tiles that one may take at any one time, the minimum length of a word, the particular numbers of dollars or other value markers used, in particular penalties and bonuses, and the like. It will be realized that these values can be greatly varied to vary the ratio of chance to skill in the game. Also, it will be noted that the numbers generated by the die 24 or other number generator can be varied considerably to thereby considerably vary the ratio of chance to skill in the game. All such variations are contemplated as coming within the scope of the present invention.

The FIG. 5 Embodiment

FIG. 5 illustrates a more preferred embodiment of the present invention. In the FIG. 5 embodiment there are four linear arrays (or word lines) of playing spaces 11 which cross each other to share the start space 18 in common. Thus, players can be building towards as many as four words at one and the same time. The word rack 10 can be thought of as having the playing spaces 11 divided into four quadrants, 30, 32, 34 and 36 with the respective playing spaces S1–S6, S7–S12, S13–S18 and S19–S24. A first of the four words would start in quadrant 30 and end in quadrant 32, a second would start in quadrant 30 and end in quadrant 36, a third would start in quadrant 34 and end in quadrant 32 and a fourth would start in quadrant 34 and end in quadrant 36.

As in the embodiment of FIG. 1, the number of word rounds which would constitute a game would be selected so as to give each player a chance to start an equal number of such rounds. Each player would also receive an equal amount of value markers 26, hereinafter referred to for convenience as "money". Or, the player's own real money can be used. Larger amounts of money are distributed if larger numbers of players are participating. Thus, for the embodiment of FIG. 5, about $4,000.00 should be available in the value markers 26.

The order of play is then randomly chosen as by throwing the die 24, selecting letters unseen, or the like.

All playing tiles 20 are placed faced down (letter and value hidden) in a "reserve pile".

The starting player buys 3 tiles for $5.00 from the reserve pile. The $5.00 is paid into the bonus fund, for example, it can be placed on a space 38 on the word rack 10.

The starting player may place one of the tiles 20 in the start space 18 and may place one or both of the remaining tiles in any one of spaces S4–S9 which, along with start space 18, constitute a central starting area 12' of the embodiment of FIG. 5. The purpose of this letter placement is to begin construction of one or more "legal" words as with the FIG. 1 embodiment. The player may, if he chooses, bluff by placing letter combinations on the word rack 10 for which he cannot produce a "legal" word. However, he may be challenged in the manner and with the penalties previously discussed. The player may also pass with the penalties previously discussed. There is a special bonus paid if a tile played in start space 18 has a numerical value of one. In such instance, the players score is doubled.

If no challenge is issued, or a challenge is successfully met, the player's "payoff" is determined by adding the face value of all tiles in the word lines to which he has claimed he is contributing and multiplying by the number rolled on the die 24. Payoff is made by all other players. Play then passes to the next player on the left.

During the next and all subsequent rounds of play, the player may discard any unwanted residual tiles (if any) from his previous turn, face up, into a "discard pile" by paying the face values of the discarded tile or tiles into the bonus fund space 38. The player may then buy up to three tiles by paying $1.00 for one tile, $3.00 for two tiles or $5.00 for three tiles, into the bonus fund space 38, or may pass, in which case he must also pay $5.00 into the bonus fund space 38. The player may also both purchase tiles and pass.

A player who chooses to place one or more of his tiles on empty spaces 11 on the word rack 10, does so. He must then indicate to which of the four word lines he is contributing. Two letters placed in the same quadrant may not be used to augment more than one word line.

After completion of the letter placement, each other player in playing order is asked if he wishes to challenge the word (or words) which have been augmented. If challenged, a legal word must be identified for each word line identified as having been augmented. Payoffs and penalties on challenges are as with the FIG. 1 embodiment. Only the challenger and challenged participate.

If no challenge is issued, or a challenge is successfully met, the player's payoff is determined by adding the face values of all the tiles in the word lines which have been augmented. The face values of tiles in some quadrants, and of the tile on start space 18, may be counted more than once. The die 24 is thrown by the player to determine a multiplier which is used to multiply the sum determined by such adding.

A word round ends if each player in turn has passed prior to purchasing tiles from the reserve pile. A word round also ends if one or more legal words are completed by a player at his turn. A player who completes one or more legal words, in addition to being paid for placing his tiles in the manner previously described, also receives all of the money in the bonus fund from space 38. He further receives from each player an amount equal to the face value of the tiles still retained by the player. When a word round ends without a word being formed, the bonus fund money remains on space 38 for distribution in the first subsequent word round in which a word is completed.

Each succeeding word round is initiated by the player to the left of the player who initiated the just finished word round.

While the invention has been described in connection with specific embodiments thereof, it will be understood that it is capable of further modification, and this application is intended to cover any variations, uses or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

That which is claimed is:

1. A word building game apparatus, comprising:

a plurality of indicators, each displaying a letter of an alphabet, or being universally useful as any letter of the alphabet, a numerical value being associated with each lettered indicator, a ratio of lettered to universally useful indicators being at least about 10 to 1;

a playing surface defining a plurality of playing spaces thereon in a single integrated linear array for receiving one or more of said playing indicators at a turn of a player, to generate a first number determined by the values associated with at least a portion of the playing indicators in position on said playing spaces following said player's turn;

means for generating a second number by chance from a selected set of numbers; and means for changing the player's score, at his turn, in an amount determined by the values of both said first and second numbers.

2. An apparatus as in claim 1, wherein said linear array of said playing surface is divided into a central starting area, a first area for positioning indicators which have letters which occur in words before the letters of indicators positioned in said central starting area and a second area for positioning indicators which have letters which occur in words after the letters of playing indicators positioned in said central starting area.

3. An apparatus as in claim 2, wherein said central starting area has a start space centrally therein, at least one space preceeding said start space and at least one space following said start space.

4. An apparatus as in claim 3, wherein the number of spaces in said linear array is at least 7.

5. An apparatus as in claim 3, wherein the number of spaces in said linear array is at least 11.

6. An apparatus as in claim 3, wherein the number of spaces in said linear array is 13.

7. An apparatus as in claim 6, wherein said number generating means comprises a six faced die, having one of the numbers 1, 2, 3, 4, 5 and 6 on each of the faces thereof.

8. An apparatus as in claim 1, wherein said means for changing a player's score comprises a plurality of value markers.

9. An apparatus as in claim 1, wherein the first number comprises the sum of the values associated with the playing indicators on the playing surface after a player takes his turn and the change in score of the player comprises a product obtained by multiplying said first number by said second number.

10. An apparatus as in claim 1, wherein said single integrated linear array includes a first linear array having a start space centrally therein and a second linear array, said second linear array sharing said start space with said first linear array and forming therewith said single integrated linear array and thereby dividing said playing spaces into first, second, third and fourth generally equal length playing space quadrants, plus said start space, so that words can be started in said first and third quadrants and ended in said second and fourth quadrants thereby defining a first word line from said first to said second quadrant, a second word line from said first to said fourth quadrant, a third word line from said third to said second quadrant and a fourth word line from said third to said fourth quadrant.

11. An apparatus as in claim 10, wherein at least one of said first and second linear arrays is divided into a central starting area which has said start space centrally therein, a first area for positioning playing indicators which have letters which occur in words before the letters of playing indicators positioned in said central starting area and a second area for positioning playing indicators which have letters which occur in words after the letters of playing indicators positioned in said central starting area.

12. An apparatus as in claim 10, wherein said first number comprises the sum of the values associated with the playing indicators in each word line which has been augmented by the player at his turn and wherein the change in score of the player comprises a product obtained by multiplying said first number by said second number.

13. An apparatus as in claim 12, wherein the number of spaces in each of said first and second linear arrays is at least 11.

14. An apparatus as in claim 13, wherein the number of spaces in each of said first and second linear arrays is 13.

15. An apparatus for playing a word forming game, comprising:

a plurality of playing indicators, each displaying either a letter of an alphabet or being universally useful as any letter of the alphabet, a numerical value being associated with each lettered indicator, a ratio of lettered to universally useful indicators being at least about 10 to 1;

a playing surface defining a plurality of playing spaces thereon in a single integrated linear array for receiving one or more of said playing indicators at the turn of a player to define a first number determined by the values associated with at least a portion of the playing indicators in position on said playing spaces at the end of said player's turn;

means for obtaining a second number by chance and for generating said player's score change responsive to the values of said first and second numbers; and means for changing said player's total running score responsive to the score change generated by said second number obtaining and score change generating means.

16. An apparatus as in claim 15, wherein said single integrated linear array includes a first linear array having a start space centrally therein and a second linear array, said second linear array sharing said start space with said first linear array and forming therewith said single integrated linear array and thereby dividing said playing spaces into first, second, third and fourth generally equal length playing space quadrants, plus said start space, so that words can be started in said first and third quadrants and ended in said second and fourth quadrants thereby defining a first word line from said first to said second quadrant, a second word line from said first to said fourth quadrant, a third word line from said third to said second quadrant and a fourth word line from said third to said fourth quadrant.

17. An apparatus as in claim 16, wherein at least one of said first and second linear arrays is divided into a central starting area which has said start space centrally therein, a first area for positioning playing indicators which have letters which occur in words before the letters of playing indicators positioned in said central starting area and a second area for positioning playing indicators which have letters which occur in words after the letters of playing indicators positioned in said central starting area.

18. An apparatus as in claim 16, wherein said first number comprises the sum of the values associated with the playing indicators in each word line which has been augmented by the player at his turn and wherein the change in score of the player comprises a product obtained by multiplying said first number by said second number.

19. An apparatus as in claim 18, wherein the number of spaces in each of said first and second linear arrays is at least 11.

20. An apparatus as in claim 19, wherein the number of spaces in each of said first and second linear arrays is 13.

21. An apparatus as in claim 15, wherein the first number comprises the sum of the values associated with the playing indicators on the playing surface after a player takes his turn and the change in score of the player comprises a product obtained by multiplying said first number by said second number.

22. An apparatus as in claim 21, wherein the number of spaces in said single integrated linear array is at least 11.

23. An apparatus as in claim 22, wherein said single integrated linear array of said playing surface is divided into a central starting area, a first area for positioning indicators which have letters which occur in words before the letters of indicators positioned in said central starting area and a second area for positioning indicators which have letters which occur in words after the letters of playing indicators positioned in said central starting area.

24. An apparatus as in claim 23, wherein said central starting area has a start space centrally therein, at least one space preceeding said start space and at least one space following said start space.

25. An apparatus as in claim 24, wherein the number of spaces in said single integrated linear array is 13.

26. An apparatus as in claim 1, wherein each of said letter displaying indicators displays only a single letter of said alphabet.

* * * * *